US006851456B2

(12) United States Patent
Baumann

(10) Patent No.: US 6,851,456 B2
(45) Date of Patent: Feb. 8, 2005

(54) WEAVING MACHINE FOR THE MANUFACTURE OF LENO CLOTHS

(75) Inventor: Heinz Baumann, Seuzach (CH)

(73) Assignee: Sultzer Textil AG, Ruti (CH)

( * ) Notice: Subject to any disclaimer, the term of this patent is extended or adjusted under 35 U.S.C. 154(b) by 278 days.

(21) Appl. No.: 10/197,117

(22) Filed: Jul. 16, 2002

(65) Prior Publication Data

US 2003/0024589 A1 Feb. 6, 2003

(30) Foreign Application Priority Data

Jul. 18, 2001 (EP) ..... 01810712

(51) Int. Cl.[7] ..... D03C 7/00

(52) U.S. Cl. ..... 139/50; 139/51; 139/52; 139/53

(58) Field of Search ..... 139/50–53

(56) References Cited

U.S. PATENT DOCUMENTS

| | | | | |
|---|---|---|---|---|
| 1,435,615 A | | 11/1922 | Moreau | |
| 2,087,449 A | * | 7/1937 | Rice et al. | 139/37 |
| 6,116,291 A | * | 9/2000 | Hockemeyer et al. | 139/51 |
| 6,315,008 B2 | * | 11/2001 | Dornier et al. | 139/50 |
| 6,382,262 B1 | * | 5/2002 | Herzig | 139/50 |
| 6,510,871 B2 | * | 1/2003 | Baumann et al. | 139/50 |

FOREIGN PATENT DOCUMENTS

| | | |
|---|---|---|
| CH | 120231 A | 5/1927 |
| DE | 466340 A | 9/1928 |
| DE | 2353658 A1 | 5/1975 |
| EP | 0534629 A1 | 3/1993 |
| EP | 1101850 A1 | 5/2001 |
| WO | WO00/03077 A1 | 1/2000 |

* cited by examiner

*Primary Examiner*—John J. Calvert
*Assistant Examiner*—Robert H. Muromoto, Jr.
(74) *Attorney, Agent, or Firm*—Townsend and Townsend and Crew LLP

(57) ABSTRACT

A weaving machine for the manufacture of leno cloths, has an element with ground needles, in particular a needle bar. The ground needles form a row in the direction of the longitudinal extent of the element. The side surfaces of the ground needles include an acute angle which is greater than 1° with a normal to the named longitudinal extent.

11 Claims, 3 Drawing Sheets

WEAVING MACHINE FOR THE MANUFACTURE OF LENO CLOTHS

BACKGROUND OF THE INVENTION

The invention relates to a weaving machine for the manufacture of leno cloths and to a needle bar for a weaving machine of this kind.

In a method for the manufacture of leno cloths, ground threads are guided, on the one hand, by a needle bar; and on the other hand leno threads are guided by a heald frame which is moved up and down as well as back and forth with respect to the needle bar. The vertically guided movement of the leno threads is a first component of movement, onto which a second component of movement is superimposed with the help of a suitably designed heald frame. The leno threads are laterally displaced by an insertion element of the heald frame, i.e. a displacement movement is carried out, so that the binding which is typical for the leno cloths arises through the change in position of the leno threads.

In every method for the manufacture of leno cloths a leno harness is used which consists of two elements, with the one element serving for the reception of the leno threads and the other for the reception of the ground threads. The element for the leno threads can for example be a guide bar or a leno thread heald frame (cf. DE-A-23 53 658). The element for the ground threads can for example be a needle bar or a ground thread element which simultaneously has the function of a reed (cf. DE-A-466 340).

A leno harness which comprises a series of ground needles is known from CH-A-120 231; an abutment lamella is in each case arranged between two adjacent ground needles for a reliable change of the leno threads. The ground needles and abutment lamella are clamped at their lower end in a carrier beam; at the upper end the ground needles are free and the abutment lamella are guided loosely.

Due to the constricted space conditions between ground needles and abutment lamella, there arises a mutual hindrance of the ground and leno threads during the change of the leno threads. Through this hindrance it can happen that individual leno threads are temporarily tensioned like a violin string during the change, and that after the hindrance has been overcome the threads dart upwardly and in so doing jump beyond the abutment lamella into a wrong position. Alternatively, as a result of the hindrance, the leno threads remain in the channel out of which they should depart so that the binding off of the weft thread cannot take place.

SUMMARY OF THE INVENTION

An object of the invention is to create a weaving machine for the manufacture of leno threads in which a hindrance between the ground and leno threads is alleviated. In addition, means are to be provided in order to eliminate the named consequence of the thread hindrance.

The weaving machine for the manufacture of leno cloths has an element with ground needles, in particular a needle bar. The ground needles form a row in the direction of the longitudinal extent of the element. The side surfaces of the ground needles include an acute angle which is greater than 1° with respect to a normal to the named longitudinal extent.

In the following the invention will be explained with reference to the drawings.

DESCRIPTION OF THE PREFERRED EMBODIMENTS

Figure 1:
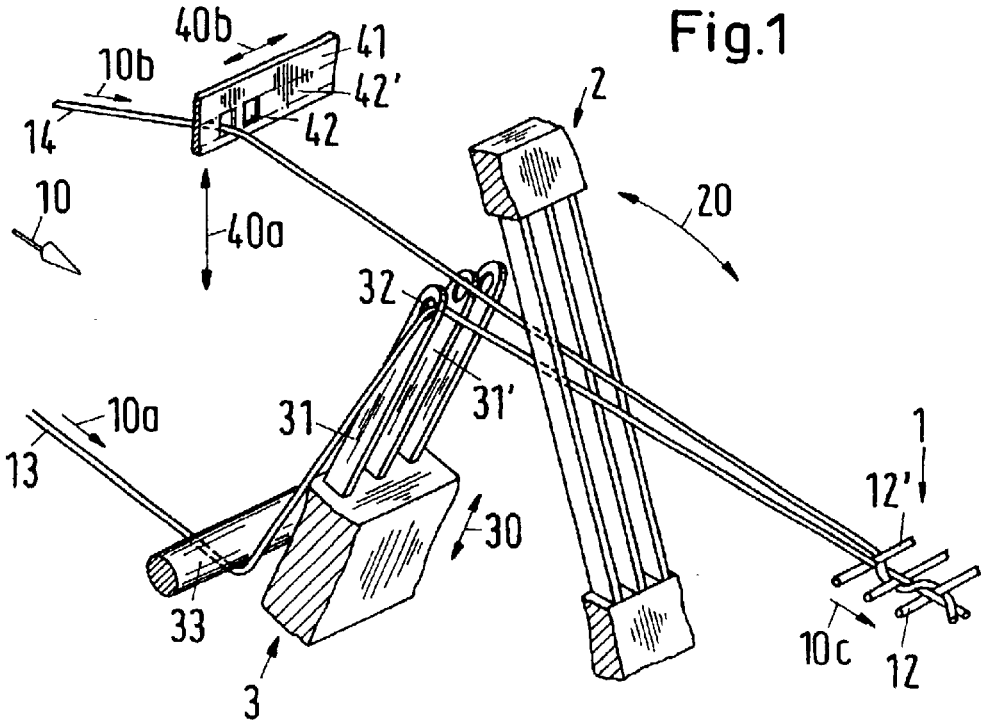
FIG. 1 illustrates parts of a weaving machine for the purpose of spatial illustration of a method for the manufacture of leno cloths.
Figure 2:
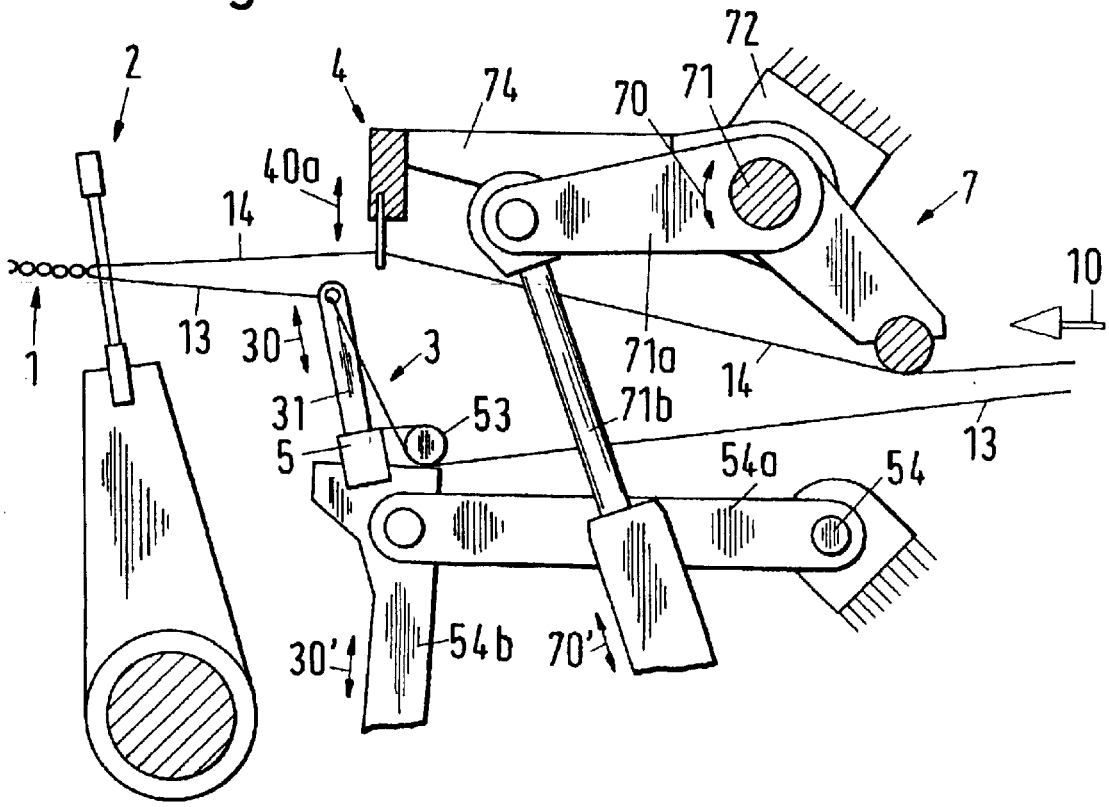
FIG. 2 is a side view of a partly illustrated weaving machine for the manufacture of leno cloths.

As illustrated in FIGS. 1 and 2, a leno cloth 1 is manufactured of weft threads 12 and warp threads, namely ground threads 13 and leno threads 14. In this the ground threads 13 are guided by a needle bar 3 and the leno threads 14 by an insertion element 4. The needle bar 3 carries needles 31 with eyes 32, which are relatively stiff eye bars. The insertion element 4 contains an insertion rail 41, which is a perforated rail with perforations 42. A row of regularly arranged perforations 42 is indicated in chain-dotted lines as the strip 42'. In FIG. 1 the transport direction 10 of the warp threads 13 and 14 (arrows 10*a* and 10*b* respectively) and of the cloth 1 (arrow 10*c*) extends from rear to front. In the corresponding arrangement of FIG. 2 the transport direction 10 extends from right to left.

For beating up a newly inserted weft thread 12' a reed 2 is actuated between the needle bar 3 and the cloth 1: double arrow 20. The needle bar 3 and the insertion element 4 are moved up and down in opposite senses: double arrows 30 and 40*a* respectively. Onto the first movement component 40*a* of the insertion rail 41 is superimposed a displacement movement as a second movement component 40*b*. The stroke of the displacement movement 40*b* is chosen in such a manner that the leno thread 14 is in each case moved from a first gap, which lies between adjacent ground needles 31 and 31', to a second gap, which is adjacent to the first one. After a weft insertion this position change of the leno thread 14 is again carried out in the opposite direction. The stroke is at least equal to the distance between the adjacent needles 31 and 31'. For a larger stroke, abutment lamella 34 which project beyond the ground needles 31 and thus force the dipping in of the leno thread 14 into the correct gap 34 are arranged between the ground needles 31 (see FIG. 3). In order that the first movement component 40*a* of the insertion element 4 can take place outside the region of the ground threads 13, the latter are deflected downwardly via a deflection bar 53.

The insertion element 4 and the needle bar 3 can be moved by an only partly illustrated pivotal arrangement, which can be connected up directly to a main drive of the weaving machine, so that the movement sequence results which is required of the weft and leno threads 13 and 14 respectively for the forming of a shed for the weft insertion. The needle bar 3 is arranged at a first toggle lever 54*a*, 54*b* between a first axle of the pivotal arrangement (not shown) and a stationary joint 54. Through an up and down movement 30' of the lever arm 54*b* there results the movement 30 of the needle bar 3. A second axle 71, which is arranged parallel to the first axle, is set via a second toggle lever 71*a*, 71*b* and an up and down movement 70' which takes place reciprocally to the movement 30', into a pendulum rotation 70 which is reversed with respect to the first axle. A connection 74 between the second axle 71 and the insertion element 4 transmits the pivotal movement to the latter and in this manner produces the vertical movement component 40*a* of the insertion rail 41. The horizontal movement component 40*b* is produced by a further non-illustrated mechanism.

Figure 3:
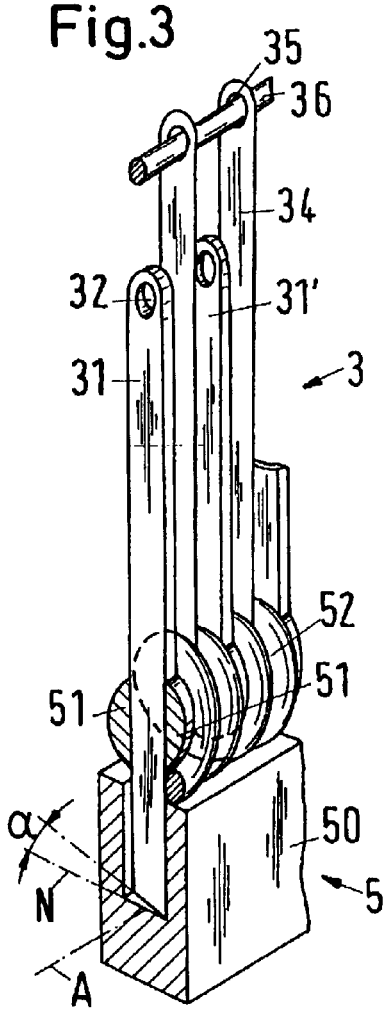
FIG. 3 illustrates part of a needle bar in accordance with the invention.

The needle bar 3 which is partly illustrated in FIG. 3 comprises a large number of ground needles 31 which form a row in the direction of the longitudinal extent A of the bar 31. The same also applies for other leno thread elements. In accordance with the invention the side surfaces of the ground needles 31, which in each case face a side surface of the adjacent ground needles 31', enclose with a normal N to the longitudinal extent A an acute angle α, which is greater than 1°, preferably greater than 2° and less than 10°. The inclined position of the needles 31 is produced with respect to the ground threads 13, and indeed in such a manner that the double deflection of the ground threads 13 is reduced on passing through the eyes 32.

Between two adjacent ground needles 31, 31' there is arranged in each case an abutment lamella 34 for a reliable change of the leno threads 14. The ground needles 31 and abutment lamella 34 are secured in a known manner at their base in a socket 5. The abutment lamella 34 are designed to be elastic and yieldingly thin, so that a lateral deflection in the direction of the longitudinal extent A of the bar can be carried out by means of the leno thread 14.

The ground needles 31 and abutment lamella 34, which stand at an inclination, are advantageously oriented parallel to one another. In this the ground needles 31 and the abutment lamella 34 are separated at the base by a wire 52, which has the shape of a spiral spring. Instead of one wire, two coil-spring-shaped wires 52 which are mutually interlaced can be provided, as is the case in the example of FIG. 3. Two bars 51, the cross-sections of which have in each case the shape of a circular segment, are inserted between the ground needles 31 and the wires 52. The lower part of the socket 5 is a section bar 50 with a longitudinal groove into which ground needles 31 are fitted for anchoring.

The upper ends of the abutment lamella 34 are connected by a wire 35 or another linear element, for example a fine-linked chain. This is a measure in order to prevent a rapid upward movement of the leno threads which goes beyond the abutment lamella. The wire or the element is in each case loosely laid into an aperture 35 of the abutment lamella 34, so that the abutment lamella 34 remain laterally deflectable.

Figure 4:
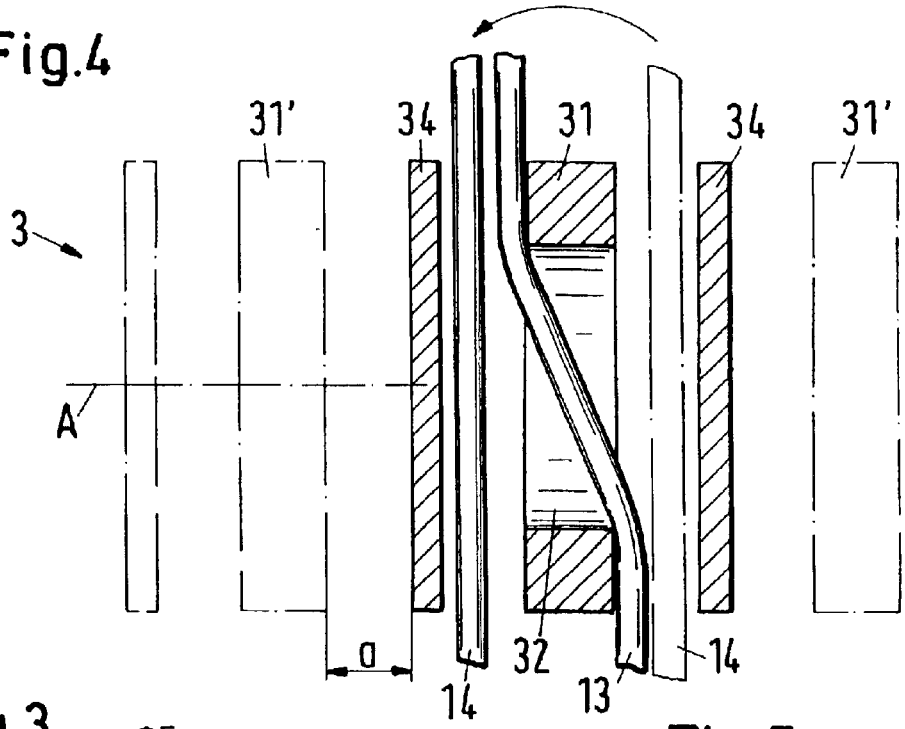
FIG. 4 is an illustration of the change of a leno thread in a needle bar in a known weaving machine.
Figure 5:
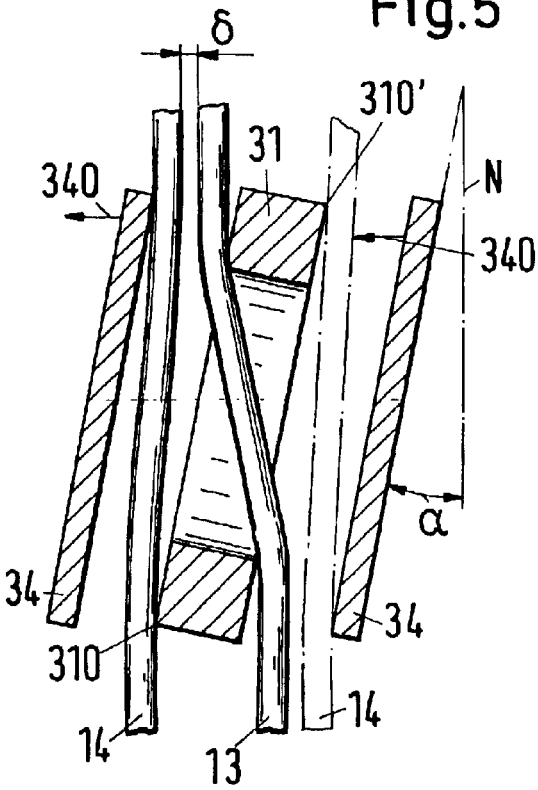
FIG. 5 is an illustration corresponding to FIG. 4 for a weaving machine in accordance with the invention.

FIG. 4 shows a cross-section through the ground needles 31, 31' and abutment lamella 34 of a known needle bar 3, with the section being placed through the eyes 32. The needles 31 are perpendicular to the longitudinal extent A of the bar. The lane width, i.e. the distance a between the ground needle 31 and the abutment lamella 34, is drawn in such a manner that it appears to be possible to carry out a change in position of the leno thread 14—indicated by the arrow 40*c*—unhindered by the ground needle 31. In fact, however, the space available is more restricted and/or transverse oscillations of the threads take place, so that as a rule a mutual hindrance between the threads 13 and 14 results. The solution in accordance with the invention through which the hindrance can be alleviated or eliminated is illustrated in FIG. 5: The ground needles 31 and—in the example illustrated—the abutment lamella 34 are inclined by an acute angle α with respect to the longitudinal extent A of the bar (see FIG. 4). With this inclination the leno thread 14 is displaced away from the ground thread 13 through the outer edge 310 (or 310' for the position of the leno thread 14 which is illustrated in chain-dotted lines respectively). There results a distance 8 between the threads 13 and 14, the size of which is greater, the greater the inclination angle α is. The inclination however has the result that the lane width is less than the original distance a. Thanks to the yielding nature of the abutment lamella 34 the latter can be laterally deflected by the leno thread 14 (arrows 340), so that the lane width becomes large enough.

Figure 6:
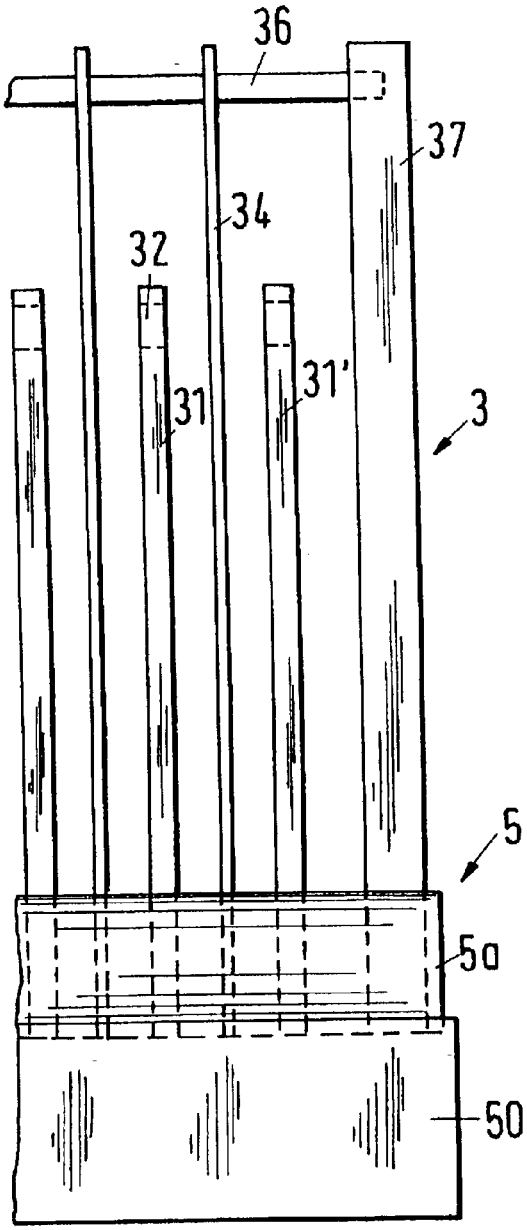
FIG. 6 is a side view of a lateral end of a needle bar, viewed transversely to the longitudinal extent of the bar.
Figure 7:
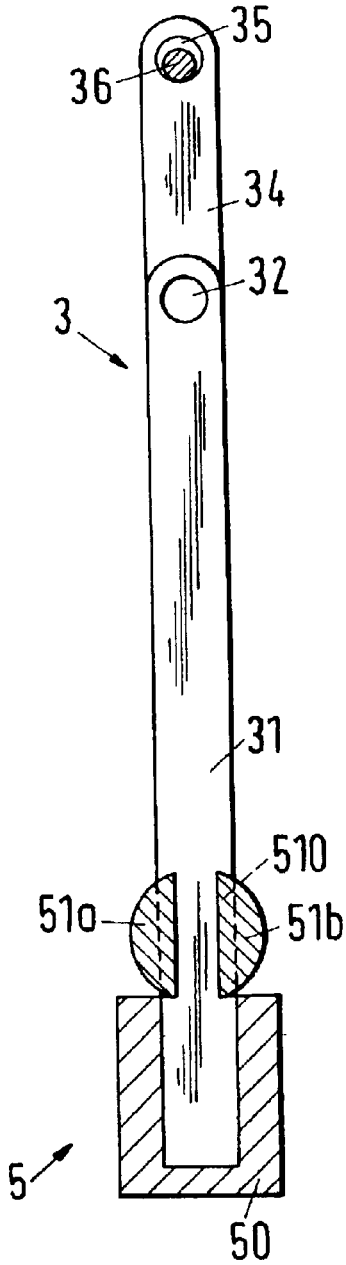
FIG. 7 is a side view of the same needle bar, viewed in the direction of the longitudinal extent of the bar.
Figure 8:
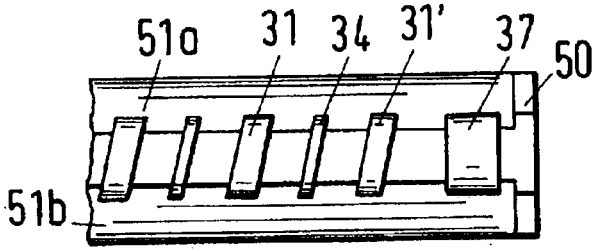
FIG. 8 is a plan view of the same needle bar.

FIGS. 6 to 7 show two side views and a plan view of a second embodiment of the needle bar 3 in accordance with the invention. The two socket rods 51*a* and 51*b* are designed in such a manner that the ground needles 31 and abutment lamella 34 can be fitted into grooves 510. The distances are no longer determined by a wire 52 (FIG. 3), but rather by the position of the grooves 510. The arrangement of the ground needles 31 and abutment lamella 34 is terminated at the two ends by one abutment bar 37 each. The latter are in each case arranged adjacently to a ground needle 31 and form a largely rigid abutment for the leno threads 34 at the ends or the outside. The lanes at the ends are therefore designed to be somewhat broader than the inwardly lying lanes.

In a further, non-illustrated embodiment a wedge piece, through which the angle α is determined, is arranged in the socket 5 between the abutment bars 37 and the adjacent ground needle 31.

What is claimed is:

1. A weaving machine for the manufacture of leno cloths, the weaving machine comprising an element including ground needles and defining a longitudinal extent, wherein the ground needles, form a row in the direction of the longitudinal extent of the element, wherein the ground needles include planar side surfaces, and wherein the planar side surfaces and a normal to the longitudinal extent, that is also normal to a longitudinal axis defined by a around needle, define an acute angle that is greater than 1°.

2. A weaving machine in accordance with claim 1, in each case an abutment lamella for a reliable change of leno threads is arranged between two adjacent ground needles, with the abutment lamella being designed to be elastic and yieldingly thin, so that a lateral deflection in the direction of the longitudinal extent can be effected by means of the leno threads.

3. A weaving machine in accordance with claim 2, wherein the ground needles and abutment lamella are arranged to be parallel to one another.

4. A weaving machine in accordance with claim 2, wherein the ground needles and the abutment lamella are separated at their base by a wire which has the shape of a coil spring, with an attachment being produced by means of a potting process and with it also being possible to provide instead of wire at least two coil-spring shaped, mutually offset wire.

5. A weaving machine in accordance with claim 2, wherein the upper ends of the abutment lamella are connected by a wire or another linear element.

6. A weaving machine in accordance with claim 5, wherein the wire or the element respectively is in each case loosely laid in into an aperture of the abutment lamella.

7. A needle bar for a weaving machine in accordance with claim 1, comprising ground needles and abutment lamella.

8. A needle bar in accordance with claim 7, wherein the acute angle between the surfaces of the ground needles and the normal to the longitudinal extent is greater than 2° and less than 10°.

9. A needle bar in accordance with claim 7, wherein the arrangement of the ground needles and abutment lamella is terminated at both ends by abutment bars which are in each case arranged adjacent to a ground needle and which form a largely rigid abutment for the leno threads at the ends.

10. A needle bar in accordance with claim 9, wherein a wedge piece by means of which the said acute angle can be determined is arranged in a socket between the abutment bar and the adjacent ground needle (31).

11. A weaving machine in accordance with claim 1 wherein the element is a needle bar.

* * * * *